US012789319B2

(12) United States Patent
Stangle et al.

(10) Patent No.: US 12,789,319 B2
(45) Date of Patent: Nov. 10, 2026

(54) ADVANCED GRIND LINE CLOSED LOOP FEEDBACK

(71) Applicant: Raytheon Technologies Corporation, Farmington, CT (US)

(72) Inventors: Tyler Stangle, East Hampton, CT (US); Brian Ricciardelli, South Windsor, CT (US); Douglas Ricciardelli, South Windsor, CT (US)

(73) Assignee: RTX Corporation, Farmington, CT (US)

( * ) Notice: Subject to any disclaimer, the term of this patent is extended or adjusted under 35 U.S.C. 154(b) by 796 days.

(21) Appl. No.: 18/141,485

(22) Filed: May 1, 2023

(65) Prior Publication Data

US 2023/0390892 A1 Dec. 7, 2023

Related U.S. Application Data

(60) Provisional application No. 63/347,668, filed on Jun. 1, 2022.

(51) Int. Cl.

| | |
|---|---|
| ***B24B 49/04*** | (2006.01) |
| ***B24B 19/14*** | (2006.01) |
| ***B24B 51/00*** | (2006.01) |

(52) U.S. Cl.

CPC ..... *B24B 49/045* (2013.01); *B24B 19/14* (2013.01); *B24B 51/00* (2013.01)

(58) Field of Classification Search

CPC ..... G05B 2219/37193; B24B 49/00; B24B 49/12; B24B 49/02; B24B 49/04; B24B 49/045; B24B 51/00; B24B 41/005; B24B 47/22; G01B 11/005; G01B 5/008

See application file for complete search history.

(56) References Cited

U.S. PATENT DOCUMENTS

| | | | | |
|---|---|---|---|---|
| 6,668,466 | B1 | 12/2003 | Bieg et al. | |
| 6,969,821 | B2 | 11/2005 | Mika et al. | |
| 9,628,775 | B2 * | 4/2017 | Bridges | G01B 5/012 |
| 2007/0155284 | A1 * | 7/2007 | Ring | B24B 37/013 700/121 |

(Continued)

FOREIGN PATENT DOCUMENTS

| | | | | |
|---|---|---|---|---|
| EP | 0492740 | A1 | 7/1992 | |
| WO | WO-2004096502 | A1 * | 11/2004 | G01B 11/03 |
| WO | WO-2011107746 | A1 * | 9/2011 | G01B 21/045 |

OTHER PUBLICATIONS

EPO Official Action issued Oct. 18, 2023 in counterpart EP Application No. 23176365.7.

*Primary Examiner* — Joel D Crandall

(74) *Attorney, Agent, or Firm* — Bachman & LaPointe, P.C.

(57) ABSTRACT

A closed loop system for a grind line including at least one grinder configured to machine a part with the grind line; a first coordinate measuring machine operatively coupled to the at least one grinder; a second coordinate measuring machine operatively coupled to the at least one grinder; and a processor operatively coupled to the at least one grinder and the first coordinate measuring machine and the second coordinate measuring machine, the processor configured to provide processor outputs to the at least one grinder responsive to data collected from the first coordinate measuring machine and the second coordinate measuring machine.

18 Claims, 3 Drawing Sheets

(56) References Cited

U.S. PATENT DOCUMENTS

| | | | | |
|---|---|---|---|---|
| 2009/0319077 | A1 | 12/2009 | Cameron | |
| 2014/0141695 | A1 | 5/2014 | David et al. | |
| 2019/0377319 | A1 | 12/2019 | Sivich et al. | |
| 2020/0064119 | A1* | 2/2020 | Gordon | G06T 7/73 |
| 2021/0026318 | A1 | 1/2021 | Blais et al. | |

* cited by examiner

ADVANCED GRIND LINE CLOSED LOOP FEEDBACK

CROSS-REFERENCE TO RELATED APPLICATION

This application claims the benefit of provisional application Ser. No. 63/347,668 filed Jun. 1, 2022.

BACKGROUND

The present disclosure is directed to machining and, more particularly, to a method of calibrating a machine line with reduced error.

Current grind processes for gas turbine engine blades use grinders in series to machine multiple features on that blade. The entire blade is then deburred and cleaned before being inspected by a single coordinate measuring machine (CMM). That single CMM must be used to keep the entire grind line in process control. An industrial process control in continuous production processes is a discipline that uses industrial control systems to achieve a production level of consistency, economy and safety which could not be achieved purely by human manual control.

The amount of information and mathematics required to target each feature is truly beyond the capability of the average operator, and is timely for even an engineer with all the resources required.

What is needed is a process for improving process control with minimal operator decisions or interaction.

SUMMARY

In accordance with the present disclosure, there is provided a closed loop system for a grind line comprising at least one grinder configured to machine a part with the grind line; a first coordinate measuring machine operatively coupled to the at least one grinder; a second coordinate measuring machine operatively coupled to the at least one grinder; and a processor operatively coupled to the at least one grinder and the first coordinate measuring machine and the second coordinate measuring machine, the processor configured to provide processor outputs to the at least one grinder responsive to data collected from the first coordinate measuring machine and the second coordinate measuring machine.

A further embodiment of any of the foregoing embodiments may additionally and/or alternatively include the closed loop system further comprising: a tangible, non-transitory memory configured to communicate with the processor, the tangible, non-transitory memory having instructions stored therein that, in response to execution by the processor, cause the processor to perform operations comprising: receiving, by the processor, inspection data for the part from each of the first coordinate measuring machine, the second coordinate measuring machine and the at least one grinder; receiving, by the processor, part configuration information taken from configuration data storage tables; conditioning, by the processor, the inspection data; determining, by the processor, a baseline of a current grind targeting; adjusting, by the processor, the grind targeting to a new nominal; and providing, by the processor, an offset to the at least one grinder.

A further embodiment of any of the foregoing embodiments may additionally and/or alternatively include the determining the baseline of the current grind targeting is responsive to filtered data produced from the inspection data, wherein the filtered data is based on a set of conditioning rules.

A further embodiment of any of the foregoing embodiments may additionally and/or alternatively include the closed loop system further comprising additional processing machines operatively coupled to the grind line, wherein the additional processing machines are selected from the group consisting of a part cleaner; a deburring machine; a flush machine and a dryer.

A further embodiment of any of the foregoing embodiments may additionally and/or alternatively include the closed loop system further comprising a communication channel operatively coupling the processor with at least one sensor of the first coordinate measuring machine and at least one sensor of the second coordinate measuring machine and/or the grind line with the at least one grinder.

A further embodiment of any of the foregoing embodiments may additionally and/or alternatively include the processor utilizes the inspection data from two different coordinate measuring machines in two separate steps of a grind series in order to adjust the at least one grinder in the grind line.

A further embodiment of any of the foregoing embodiments may additionally and/or alternatively include the processor utilizes the inspection data from both of: the first coordinate measuring machine determined at a predetermined time; and the inspection data from the second coordinate measuring machine at an additional predetermined time.

In accordance with the present disclosure, there is provided a closed loop system comprising a computer readable storage device readable by the system, tangibly embodying a program having a set of instructions executable by the system to perform the following steps for a grind line, the set of instructions comprising: an instruction to receive inspection data for a part from each of a first coordinate measuring machine, a second coordinate measuring machine and at least one grinder; an instruction to receive part configuration information taken from configuration data storage tables; an instruction to condition the inspection data; an instruction to determine a baseline of a current grind targeting; an instruction to adjust the grind targeting to a new nominal; and an instruction to provide an offset to the at least one grinder.

A further embodiment of any of the foregoing embodiments may additionally and/or alternatively include the instruction to determine the baseline of the current grind targeting is responsive to filtered data produced from the inspection data, wherein the filtered data is based on a set of conditioning rules.

A further embodiment of any of the foregoing embodiments may additionally and/or alternatively include the closed loop system further comprising an instruction to adjust the at least one grinder in the grind line utilizing the inspection data from two different coordinate measuring machines in two separate steps of a grind series.

A further embodiment of any of the foregoing embodiments may additionally and/or alternatively include the closed loop system further comprising an instruction to utilize the inspection data from both of: the first coordinate measuring machine determined at a predetermined time; and the inspection data from the second coordinate measuring machine at an additional predetermined time.

In accordance with the present disclosure, there is provided a process for a closed loop system comprising: providing at least one grinder configured to machine a part with the grind line; a first coordinate measuring machine operatively coupled to the at least one grinder; a second coordinate measuring machine operatively coupled to the at least one grinder; and a processor operatively coupled to the at least one grinder and the first coordinate measuring machine and the second coordinate measuring machine; configuring the processor to provide processor outputs to the at least one grinder responsive to data collected from the first coordinate measuring machine and the second coordinate measuring machine.

A further embodiment of any of the foregoing embodiments may additionally and/or alternatively include the process further comprising providing a tangible, non-transitory memory configured to communicate with the processor, the tangible, non-transitory memory having instructions stored therein that, in response to execution by the processor, cause the processor to perform operations comprising: receiving, by the processor, inspection data for the part from each of the first coordinate measuring machine, the second coordinate measuring machine and the at least one grinder; receiving, by the processor, part configuration information taken from configuration data storage tables; conditioning, by the processor, the inspection data; determining, by the processor, a baseline of a current grind targeting; adjusting, by the processor, the grind targeting to a new nominal; and providing, by the processor, an offset to the at least one grinder.

A further embodiment of any of the foregoing embodiments may additionally and/or alternatively include the step of determining the baseline of the current grind targeting is responsive to filtered data produced from the inspection data, wherein the filtered data is based on a set of conditioning rules.

A further embodiment of any of the foregoing embodiments may additionally and/or alternatively include the process further comprising calculating the changes required in the at least one grinder to target the process to nominal utilizing the data.

A further embodiment of any of the foregoing embodiments may additionally and/or alternatively include the process further comprising deriving an algorithm employed by the processor using a part feature geometry, a grind process, and an inspection technique using a configuration table.

A further embodiment of any of the foregoing embodiments may additionally and/or alternatively include the process further comprising utilizing the inspection data from both of the first coordinate measuring machine determined at a predetermined time; and the inspection data from the second coordinate measuring machine at an additional predetermined time.

A further embodiment of any of the foregoing embodiments may additionally and/or alternatively include the process further comprising utilizing the data from two different coordinate measuring machines in two separate steps of a grind series in order to adjust the at least one grinder in the grind line.

Other details of the process are set forth in the following detailed description and the accompanying drawings wherein like reference numerals depict like elements.

DETAILED DESCRIPTION

Figure 1:
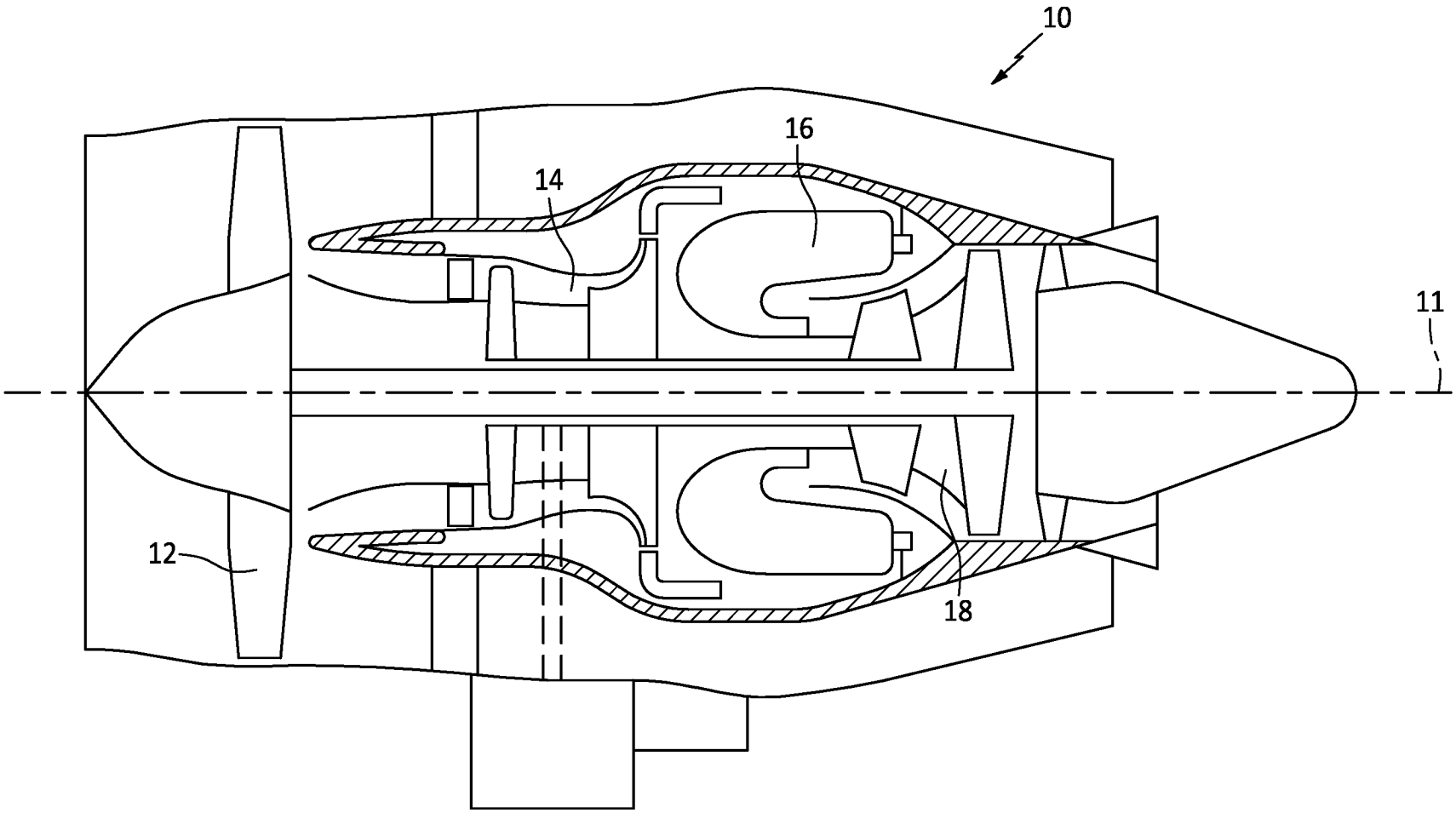
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2:
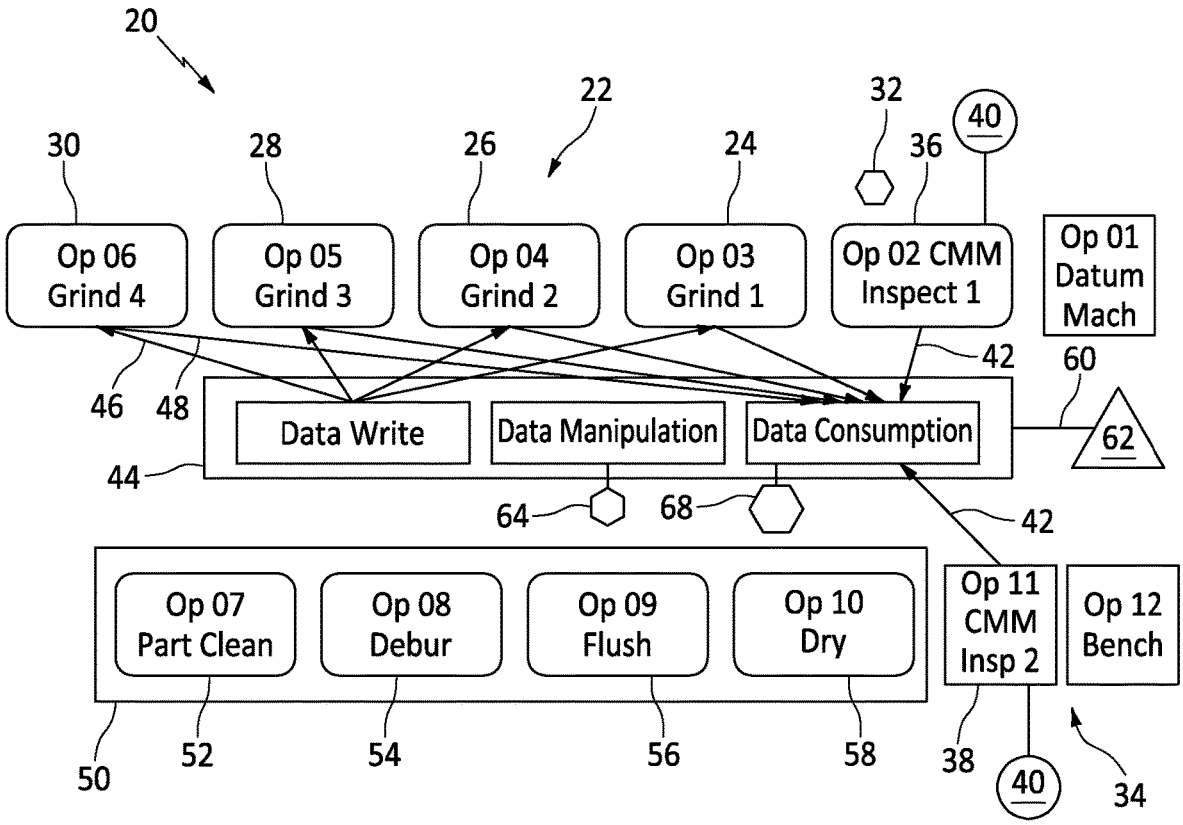
FIG. 2 is a schematic representation of a closed loop system architecture.
Figure 4:
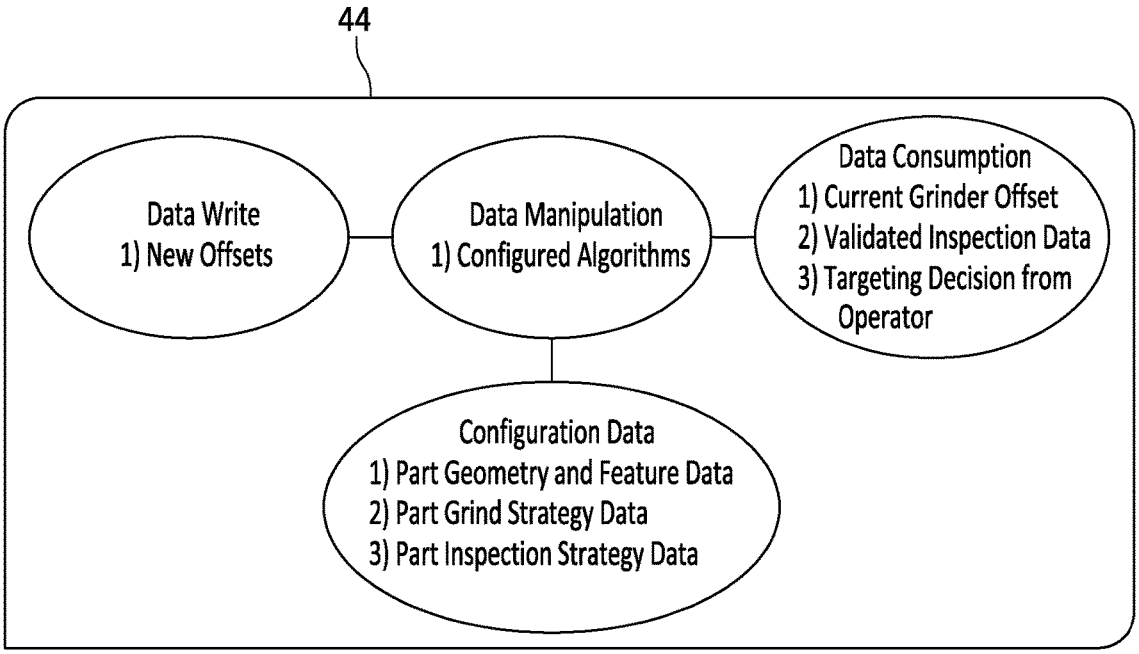
FIG. 4 is a schematic representation of an exemplary processor.

Referring also to FIG. 2 and FIG. 4, an exemplary closed loop system 20 is shown. The closed loop system 20 includes a set of grinding machines or simply grind line 22. The grind line 22 includes a first grinder 24, second grinder 26, third grinder 28 and fourth grinder 30. In an alternative embodiment, there can be multiple grinders. The grind line 22 is configured to process a part 32, such as a blade, from the first grinder 24 through the fourth grinder 30. Many components in the gas turbine engine 10, such as the example presented in FIG. 1, are manufactured using grinder machines, and grinder machines are also used for manufacturing components in other industries than the gas turbine engine industry.

The grind line 22 is configured to process the part 32 in series to machine multiple features of the part 32. Each of the grind line 22 grinders 24, 26, 28, 30 can be utilized to complete a different feature on the part 32. The grinders 24, 26, 28, 30 are machines that require calibration and adjustment in order to maintain process control to achieve a production level of consistency, economy and safety. The grinders 24, 26, 28, 30 also need to be adjusted/configured based on the type of part 32 being machined.

The closed loop system 20 also includes inspection devices 34, such as a CMM. The CMM is a piece of equipment that measures the geometries of physical objects. CMMs can use a probing system with sensor(s) 40 to detect discreet points on the surfaces of objects, such as part 32. In an exemplary embodiment, the closed loop system 20 can include a first CMM 36 and a second CMM 38.

One significant feature of CMM machine is the calibration feature. Indeed, CMM 36, 38 are typically provided with sensor(s) 40 which can track the relative position of features on one or more part(s) 32, and a software which operates the machine, which involves moving the part 32, in a frame of reference, based on the feedback from the sensor(s) 40. The CMM 36, 38 can create inspection data 42 that is utilized to manufacture the part 32. The sensor(s) 40 are the eyes of the CMM machine which allows the software to know where the part 32 is located. The software is used for many different machines, which may have slight variations in the frame of reference from one machine to another. The CMM can be calibrated to take into account the specific architecture of the CMM. The calibration can involve setting an origin and an orientation of the frame of reference based on the measured position of reference elements in the actual CMM. The reference elements can constitute a coordinate system, and the calibration can involve setting the origin and orientation of axes of the frame of reference of the grinder 24, 26, 28, 30 relative to this coordinate system. Typically, the part 32 is moveable in three dimensions and the frame of reference of the grinder 24, 26, 28, 30 is thus 3-dimensional. It can use Cartesian coordinates, cylindrical coordinates, or spherical coordinates, to name three examples, depending on what was considered most suitable by the software engineers based on the specifics of the actual grinder 24, 26, 28, 30 the software is designed for.

The closed loop system 20 includes a processor(s) 44. Processor data 46 may be transmitted to one or more processors 44 (e.g., computer systems having a central processing unit and memory) for recording, processing and storing the data 42 received from sensors 40. Processor 44 may include a general-purpose processor, a digital signal processor (DSP), an application specific integrated circuit (ASIC), a field programmable gate array (FPGA) or other programmable logic device, discrete gate or transistor logic, discrete hardware components, or any combination thereof. Processor 44 may be in communication (such as electrical communication) with sensors 40 and may be configured to receive input, such as images and/or depth information from sensors 40. Processor 44 may receive data 42 about the part 32 captured and transmitted by the sensor(s) 40 and/or grind line 22 via a communication channel 48. Upon receiving the data 42, the processor 44 may process data 46 from sensors 40 to determine if correct process controls are present with the grind line 22.

The close loop system 20 includes additional processing machines 50 that operate to manufacture the part 32 after the grinder 24, 26, 28, 30. The additional processing machines 50 can include a part cleaner 52 configured to remove unwanted materials from the part 32. A deburring machine 54 is also included in the additional processing machines 50. The deburring machine 54 deburrs the part 32. A flush machine 56 is also utilized to flush debris to process the part 32. A dryer 58 is also utilized to dry the part 32.

During use of the grind line 22, the part 32 can change design, thus requiring a reconfiguration of the grind line 22. Also, a part 32 that is not affiliated with the design of other parts 32 being machined in the grind line 22 can be inserted into the production run. In either situation, it is necessary to ensure that the grind line 22 is within process control parameters.

Figure 3:
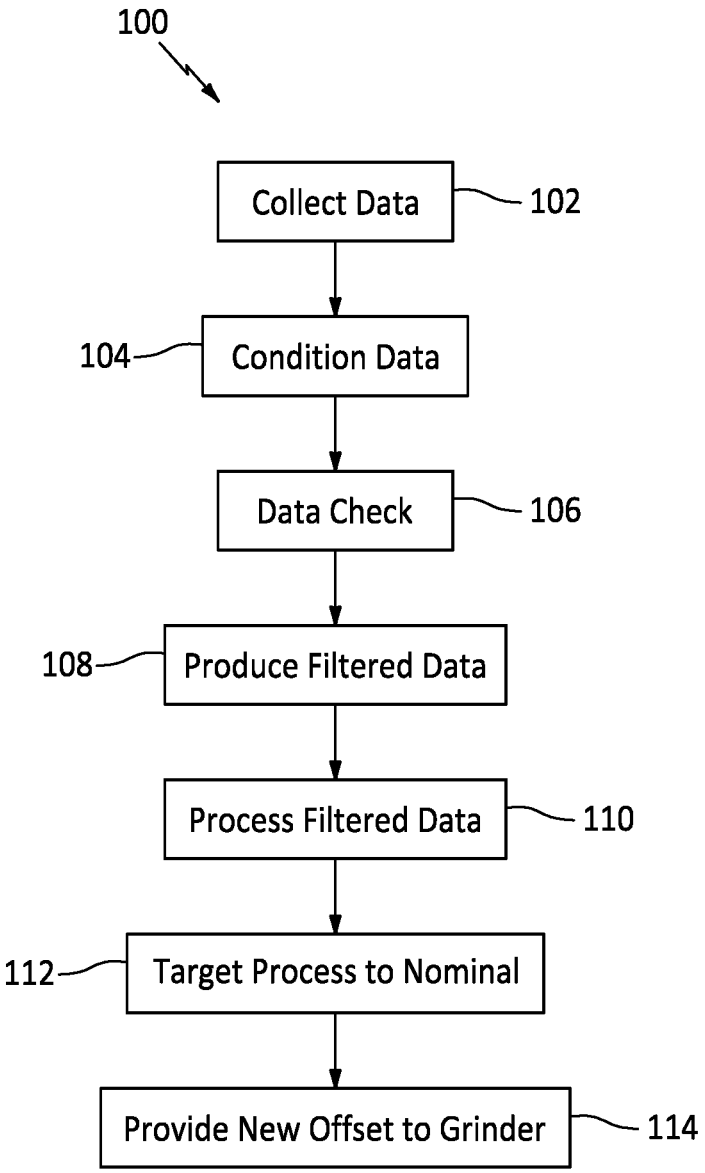
FIG. 3 is a process map of the exemplary process

Referring also to FIG. 3, a process schematic, shows an exemplary process 100. In use the closed loop system 20 can be utilized to process a series of parts 32. In step 102, data collection, the first CMM 36 and second CMM 38 provides inspection data 42 about the part 32, as well as data 42 from grinders 24, 26, 28, 30 to processor 44. The processor(s) 44 utilizes the data 42 as well as part configuration information 60 taken from configuration data storage tables 62. The part configuration information can include various design parameters for the features of particular parts 32. The processor(s) 44 then conditions the data 42 at step 104. Conditioning and checking the data 42 includes removing data 42 that is an outlier. Unwanted data can include data ground during a previous run, or with different offsets is removed. This is controlled with the 6 rules shown in the table below. The processor(s) 44 checks the data 42. The data checking step 104 can be performed several times and in a variety of techniques.

At step 106, the processor(s) 44 produces filtered data 64. An exemplary way to filter the data 42 is to select a predetermined quantity, such as ten records from the database that includes the inspection data 42 of the part 32 and that was reported on the second CMM 38 that is the final CMM used to measure the part 32. The processor(s) 44 is configured to average the ten records for all feature attributes being inspected to create the filtered data 64. This technique creates a baseline of how the process is currently targeted. Targeted refers to where the mean of the inspected dimension is with regard to the nominal value, taking into account the tolerance size. For example, with a nominal value of 0.000" a mean of +0.0005" with a tolerance of +/−.002" is well targeted. As a subset of the step 106, the sample set of the predetermined quantity of data 42 includes verifying that the samples are appropriate to be used for the filtered data 64. It is necessary to confirm that the data 42 is usable data that are a product of the current grind targeting. It is possible that some of the sample data 42 does not represent the current grind line 22 production run. A set of conditioning rules 66 have been established in order to properly produce the filtered data 64. The filtered data 64 comprises data that meets the requirements of the conditioning rules 66.

With reference to Table 1, the conditioning rules 66 are set forth.

| Rule | Problem | Solution |
|---|---|---|
| 1 | Different Part number | Verify part number of CMM-1, CMM-2 records and part number associated with each grinder program match. Information pulled from configuration table for grind programs. |
| 2 | Parts not ground during this run, old parts being inspected out of order | Pull last 30 records on CMM-1. Make sure that part was run in last 30 records, which proves it was made in this run |
| 3 | Verify that part was run with current offsets in the machine. Operators often run a part ahead, bypassing other parts to verify changes they make. | Pull both CMM-1 and CMM-2 timestamp for the record. Pull the timestamp of the last offsets made in all 4 grinders. Make sure both CMM-1 and CMM-2 timestamps are more recent than offset changes. |
| 4 | Verify part is not an outlier | Check actual measurement data for each feature. If more than 150% of tolerance, ask operator if they want to remove this point. Sometimes after maintenance events or changeovers they may need to use this point. |
| 5 | Changeovers | Verify that the part was not run before a changeover occurred using CMM-1 and CMM-2 timestamps. Changeovers are tracked by a source code. |
| 6 | Special Condition: During Changeover or full line part was run in CMM-1 prior to offsets being loaded into a grinder | The operator may have run the part in CMM-1 prior to adjusting the offsets in a machine. This would lead to the timestamp of CMM-1 failing rule 1 for the part that was actually ground with the current offsets. To solve this, if the |

-continued

| Rule | Problem | Solution |
|---|---|---|
| | | data conditioning shows 0 of the 10 parts pulled can be used, a special condition is applied. The part with a timestamp in CMM-1 directly prior to the last offset change can be used. This would result in a single part being used. |

Any part 32 that passes all conditioning rules 66 can be utilized for the next step of the closed loop system 20. Any part 32 that fails one or more rules can be removed from the data set. The conditioning rules 66 allow for the closed loop system 20 to only use valid data even in with a complex grind series, and even with all the part flow challenges that occur in a shop environment. At the end of the data filtering and conditioning steps, the closed loop system 20 has one to ten verified, useable part inspection records and the current offsets from the grinders 24, 26, 28, 30. This is the end of the data consumption phase.

The next step 108 is for the processor(s) 44 to process the filtered data 64 by use of algorithms 68 to configure the targeted features back into a nominal value with a consideration of the complex interactions between all of the part features and the grinder line 22.

The processor(s) 44 utilizes the inspection data 42 from both the first CMM 36 determined at a predetermined time as well as the inspection data 42 from the second CMM 38 at an additional predetermined time. The processor(s) 44 utilizes inspection data 42 from two different measuring machines (36, 38) in two separate steps of the grind series in order to adjust each of the grinders in the same grind line 22. In an exemplary embodiment, the inspections by the first CMM 36 and second CMM 38 can be after several production runs. The inspection sequences are also intentionally not performed directly after machining occurs, thus creating a gap in time between machining and the feedback from the processor(s) 44.

Algorithms 68 specific to this process 100 are written in a highly configurable way to allow for adjustments from one part 32 to another part 32. For example, the differences from a blade A to another blade B are threefold. First, the machining strategy differs from blade A to blade B. For example, the rotations of the table during machining the same feature on blade A can be different from blade B. Second, the geometry of the blades and the features machined differ. Third, the inspection technique and vectors used on the CMM 36, 38 differ. To have the same algorithms and source code work for the entire series of current generation blades, they were written to consume part specific configuration data which is fed from a 54-column configuration table 62 created and modified by engineers. The process 100 also allows a new part number to be added to the closed loop system 20 by simply adding a line to the configuration table 62 and inputting all the required values, rather than developing source code and algorithms specific to that new part 32 saving time and leveraging all previous work and testing. This data feed can be seen in FIG. 4.

Additionally, the interconnectivity of the 4 grinders 24, 26, 28, 30 is considered next. The process 100 allows for operators (not shown) to choose to adjust the entire grind line 22 at once, which makes preemptive moves in first grinder 24 and second grinder 26 to adjust for the changes being made to the feature's datum in third grinder 28, while also targeting the features to nominal. If the operator deems that only grinders 24, 26 or 30 need retargeting, the interconnectivity is dropped from the algorithms and allows for only targeting the features in that specific grinder. This decision is made on the main splash screen of the software as seen in FIG. 5.

At step 110, with all the data 42 required, the algorithms 68 are run in the processor(s) 44 to calculate the deltas, or changes required in each grinder 24, 26, 28, 30 to target the process to nominal. These algorithms 68 are derived using intimate understanding of a part features geometry, grind process, and inspection techniques with extensive consideration for flexibility using the configuration table 62. They use the availability of machine X, Y, Z, A, B, & T (running taper) corrections to target each feature to nominal. Target the process to nominal means to adjust the machining offsets to drive the desired dimension toward the nominal value.

In an exemplary embodiment, there are normally 4 cuts in the first grinder 24, 2 cuts in second grinder 26, 2 cuts in third grinder 28, and up to 4 cuts in fourth grinder 30 that are controlled by between 32 and 43 CMM inspection points. The closed loop system 20 targets all but two of those to nominal. The remaining two are control limits for a serration form requirement and are better adjusted using a shadowgraph visual inspection technique because there is no true, nominal to target on the CMM 36, 38. At the end of this step 110, the closed loop system has a list of all the changes to make to each grinder 24, 26, 28, 30. The processor 44 then calculates the new offsets for each machine using the deltas and the current offsets pulled earlier.

The final step 112 of the closed loop system 20 is to feed these new offsets to each grinder 24, 26, 28, Before writing to the grinding machines 24, 26, 28, 30, the processor(s) 44 checks to verify connectivity to each grinder 24, 26, 28, 30. If there is no connection the processor(s) 44 will provide the operator (not shown) with a message that no connection was found, and offsets cannot be written directly but must be manually entered from a printed report. If there is connection, the processor(s) 44 does a last check to make sure the grinding machine 24, 26, 28, 30 is not in cycle. Writing offsets to the grinding machine 24, 26, 28, 30 while it is in cycle is risky and unwanted. Therefore, if the grinding machine 24, 26, 28, 30 is in cycle, processor(s) 44 will provide the operator with a message that the grinder 24, 26, 28, 30 is in cycle and to wait to write the new offsets. Once the cycle is complete, the operator can successfully write the new offsets. At this point, the entire closed loop system 20 has been completed. The operator will then have to wait until the part 32 changes ground with new offsets is inspected by second CMM 38 for the processor(s) 44 to be used again. This is protected with rule 3 of the processor(s) 44 data conditioning rules 66.

A technical advantage to the process and system disclosed includes a unique, powerful, solution with greater ability for data filtering and conditioning, machine strategy input and configuration.

Another technical advantage to the process and system disclosed includes providing a solution which respects that there be a gap between machining and feedback in a shop environment that leads to uncertainty with measuring results and part flow due to rework, re-inspection, operator induced errors in the part flow and common process failures.

Another technical advantage to the process and system disclosed includes

Another technical advantage to the process and system disclosed includes

There has been provided a process and system. While the process and system have been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A closed loop system for a grind line comprising:

at least one grinder configured to machine a part with the grind line;

a first coordinate measuring machine operatively coupled to said at least one grinder;

a second coordinate measuring machine operatively coupled to said at least one grinder; and a processor operatively coupled to said at least one grinder and said first coordinate measuring machine and said second coordinate measuring machine, said processor configured to provide processor outputs to said at least one grinder responsive to data collected from said first coordinate measuring machine and said second coordinate measuring machine.

2. The closed loop system according to claim 1, further comprising:

a tangible, non-transitory memory configured to communicate with said processor, the tangible, non- transitory memory having instructions stored therein that, in response to execution by the processor, cause the processor to perform operations comprising:

receiving, by the processor, inspection data for said part from each of said first coordinate measuring machine, said second coordinate measuring machine and said at least one grinder;

receiving, by the processor, part configuration information taken from configuration data storage tables;

conditioning, by the processor, the inspection data;

determining, by the processor, a baseline of a current grind targeting;

adjusting, by the processor, the grind targeting to a new nominal; and providing, by the processor, an offset to said at least one grinder.

3. The closed loop system according to claim 2, wherein said determining said baseline of the current grind targeting is responsive to filtered data produced from said inspection data, wherein said filtered data is based on a set of conditioning rules.

4. The closed loop system according to claim 1, further comprising:

additional processing machines operatively coupled to said grind line, wherein the additional processing machines are selected from the group consisting of a part cleaner; a deburring machine; a flush machine and a dryer.

5. The closed loop system according to claim 1, further comprising a communication channel operatively coupling the processor with at least one sensor of said first coordinate measuring machine and at least one sensor of said second coordinate measuring machine and/or the communication channel operatively coupling the processor with the grind line including the at least one grinder.

6. The closed loop system according to claim 1, wherein said processor utilizes the inspection data from the first coordinate measuring machine and the second coordinate measuring machine in two separate steps of a grind series in order to adjust the at least one grinder in the grind line.

7. The closed loop system according to claim 1, wherein said processor utilizes the inspection data from both of:

the first coordinate measuring machine determined at a predetermined time; and the inspection data from the second coordinate measuring machine at an additional predetermined time.

8. A closed loop system comprising a computer readable storage device readable by the system, tangibly embodying a program having a set of instructions executable by the system to perform the following steps for a grind line, the set of instructions comprising:

an instruction to receive inspection data for a part from each of a first coordinate measuring machine, a second coordinate measuring machine and at least one grinder;

an instruction to receive part configuration information taken from configuration data storage tables;

an instruction to condition the inspection data;

an instruction to determine a baseline of a current grind targeting;

an instruction to adjust the grind targeting to a new nominal; and an instruction to provide an offset to said at least one grinder.

9. The closed loop system according to claim 8, wherein said instruction to determine said baseline of the current grind targeting is responsive to filtered data produced from said inspection data, wherein said filtered data is based on a set of conditioning rules.

10. The closed loop system according to claim 8, wherein the set of instructions further comprises:

an instruction to adjust the at least one grinder in the grind line utilizing the inspection data from two different coordinate measuring machines in two separate steps of a grind series.

11. The closed loop system according to claim 8, wherein the set of instructions further comprises:

an instruction to utilize the inspection data from both of:

the first coordinate measuring machine determined at a predetermined time; and the inspection data from the second coordinate measuring machine at an additional predetermined time.

12. A process for a closed loop system comprising:

providing at least one grinder configured to machine a part with the grind line, a first coordinate measuring machine operatively coupled to said at least one grinder, a second coordinate measuring machine operatively coupled to said at least one grinder, and a processor operatively coupled to said at least one grinder and said first coordinate measuring machine and said second coordinate measuring machine;

configuring said processor to provide processor outputs to said at least one grinder responsive to data collected from said first coordinate measuring machine and said second coordinate measuring machine.

13. The process of claim 12, further comprising:

providing a tangible, non-transitory memory configured to communicate with said processor, the tangible, non-transitory memory having instructions stored therein that, in response to execution by the processor, cause the processor to perform operations comprising:

receiving, by the processor, inspection data for said part from each of said first coordinate measuring machine, said second coordinate measuring machine and said at least one grinder;

receiving, by the processor, part configuration information taken from configuration data storage tables;

conditioning, by the processor, the inspection data;

determining, by the processor, a baseline of a current grind targeting;

adjusting, by the processor, the grind targeting to a new nominal; and providing, by the processor, an offset to said at least one grinder.

14. The process of claim 13, wherein the step of determining said baseline of the current grind targeting is responsive to filtered data produced from said inspection data, wherein said filtered data is based on a set of conditioning rules.

15. The process of claim 12, further comprising:

calculating the changes required in said at least one grinder to target the process to nominal utilizing the data.

16. The process of claim 12, further comprising:

deriving an algorithm employed by the processor using a part feature geometry, a grind process, and an inspection technique using a configuration table.

17. The process of claim 12, further comprising:

utilizing the inspection data from both of:

the first coordinate measuring machine determined at a predetermined time; and the inspection data from the second coordinate measuring machine at an additional predetermined time.

18. The process of claim 17, further comprising:

utilizing the data from two different coordinate measuring machines in two separate steps of a grind series in order to adjust the at least one grinder in the grind line.

* * * * *